US008079921B2

(12) United States Patent
Sato et al.

(10) Patent No.: US 8,079,921 B2
(45) Date of Patent: Dec. 20, 2011

(54) GOLF BALL

(75) Inventors: Katsunori Sato, Chichibu (JP); Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 1102 days.

(21) Appl. No.: 11/429,320

(22) Filed: May 8, 2006

(65) Prior Publication Data

US 2007/0259738 A1 Nov. 8, 2007

(51) Int. Cl.
*A63B 37/12* (2006.01)

(52) U.S. Cl. ..... 473/383

(58) Field of Classification Search ..... 473/383–385
See application file for complete search history.

(56) References Cited

U.S. PATENT DOCUMENTS

| | | | | |
|---|---|---|---|---|
| 4,681,323 | A | 7/1987 | Alaki et al. | |
| 2005/0046071 | A1 * | 3/2005 | Endo et al. | 264/161 |
| 2005/0130768 | A1 * | 6/2005 | Yokota et al. | 473/378 |
| 2006/0068941 | A1 * | 3/2006 | Sajima | 473/378 |
| 2006/0116222 | A1 * | 6/2006 | Sajima et al. | 473/383 |

* cited by examiner

*Primary Examiner* — Raeann Gorden
(74) *Attorney, Agent, or Firm* — Sughrue Mion, PLLC

(57) ABSTRACT

The invention provides a golf ball having numerous dimples on a surface thereof, wherein at least one dimple cross-sectional shape is a cycloid curve or a trochoid curve. By thus optimizing the cross-sectional shape of the dimples, the aerodynamic performance due to the dimple effect is enhanced, enabling the distance traveled by the ball to be increased.

7 Claims, 4 Drawing Sheets

CYCLOID (TROCHOID)

DOUBLE

ORDINARY

CYCLOID (TROCHOID)

DOUBLE

ORDINARY

CYCLOID $$\begin{cases} x = a\theta - a\sin\theta = a(\theta - \sin\theta) \\ y = a - a\cos\theta = a(1 - \cos\theta) \end{cases}$$

TROCHOID $$\begin{cases} x = a\theta - b\sin\theta \\ y = a - b\cos\theta \end{cases} \quad (b < a)$$

GOLF BALL

BACKGROUND OF THE INVENTION

The present invention relates to a golf ball having numerous dimples on the surface thereof. More particularly, it relates to a golf ball which, through optimization in the shape of the dimples, has an improved aerodynamic performance and a stable flight performance.

For a golf ball which has been hit to travel a long distance, it is important that the ball itself have a high rebound and that air resistance during flight be reduced by dimples arranged on the surface of the ball. A variety of approaches from the standpoint of, e.g., type, shape, and surface coverage on the ball can be taken for improving the dimples. For example, the aerodynamic performance is improved by increasing the surface coverage of the dimples to stabilize the trajectory of the ball.

When a large number of dimples are formed on a golf ball, the dimple sizes, volumes and other characteristics that determine the cross-sectional shapes of the dimples have in the past been quantified by using circular arcs to mathematically describe the cross-sectional shapes of the dimples, and changing these variables as appropriate. However, this process took time to find the numerical values that fit the desired dimple characteristics such as size and volume, in addition to which it grew complicated.

U.S. Pat. No. 4,681,323 describes what might be referred to as a "double" dimple shape composed of a recessed dimple within which there is formed another recess. Such dimples enable the dimple volume to be enlarged without increasing the dimple diameter, and thus make it possible to extend the distance traveled by the ball.

However, in a double dimple shape, the cross-sectional shape of the dimple resulting from the combination to two differing circular arcs is complex. Numerically quantifying such shapes is thus complicated, as a result of which it takes time to determine the optimal volume occupancy VR.

SUMMARY OF THE INVENTION

It is therefore an object of the present invention to provide a golf ball which has an improved aerodynamic performance due to the dimple effect, and can thus travel a longer distance.

Accordingly, the invention provides a golf ball having numerous dimples on a surface thereof, wherein at least one dimple cross-sectional shape obtained by transecting the ball from an outer surface to a center of the ball is a cycloid curve or a trochoid curve.

The present invention concerns in particular the cross-sectional shape of dimples on the ball when the ball is transected from the outer surface to the center of the ball. The cross-sectional shape is unique and enables the dimple size and volume to be efficiently quantified. Due to the effects of dimples having this cross-sectional shape, the aerodynamic performance of the ball is improved, making it possible to increase the distance traveled by the ball.

In the invention, it is preferable that the dimples formed on the surface of the ball be of at least three types of differing diameter and/or depth. Also, it is preferable that the dimples for which the foregoing cross-sectional shape is a cycloid curve or a trochoid curve account for at most 80% of the total number of dimples.

BRIEF DESCRIPTION OF THE DIAGRAMS

DETAILED DESCRIPTION OF THE INVENTION

The invention is described below in conjunction with the attached diagrams.

FIG. 1 is a top view (photograph) of a golf ball according to a first example of the invention. The surface of the ball has numerous dimples.

Of the numerous dimples, the cross-sectional shape of at least one dimple has the same shape as a cycloid curve or a trochoid curve. As used herein, "dimple cross-sectional shape" refers to the cross-sectional shape obtained by transecting the ball from the outer surface to the center of the ball.

Figure 2A:
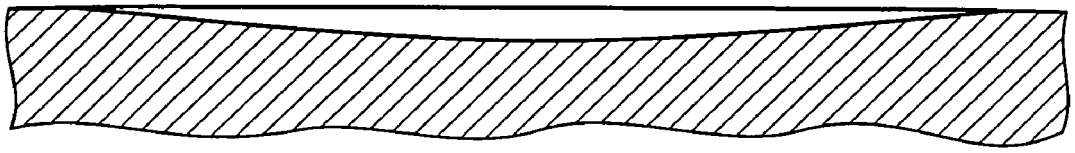
FIG. 2(A) is an enlarged cross-sectional view showing the cross-sectional shape of a dimple according to the invention.
Figure 2B:
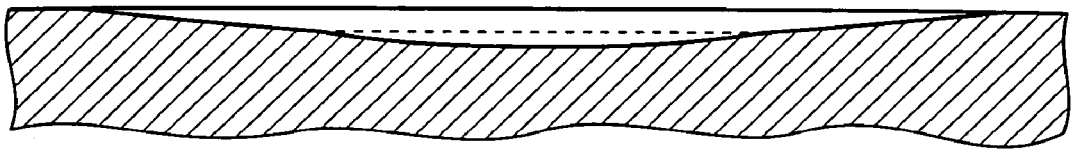
FIG. 2(B) is an enlarged cross-sectional view of a double dimple.
Figure 2C:
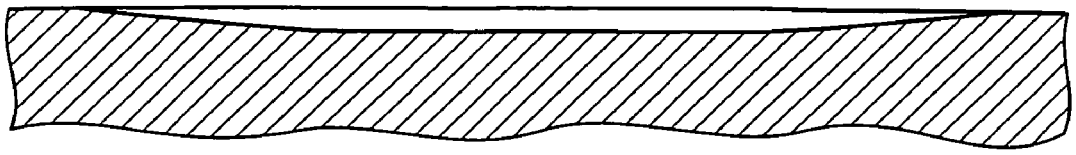
FIG. 2(C) is an enlarged cross-sectional view of an ordinary dimple.

Here, by designing the dimple cross-sectional shape based on a cycloid curve or a trochoid curve, flexible accommodation to a preset dimple size or volume is possible. FIG. 2(A) is a cross-sectional view of a cycloid curve. In addition, FIGS. 2(B) and (C) are cross-sectional views of a double dimple and an ordinary dimple, respectively.

By quantifying the dimple size and volume conditions using a cycloid curve or a trochoid curve, the dimple effect is increased, enhancing the aerodynamic performance.

Figure 3A:
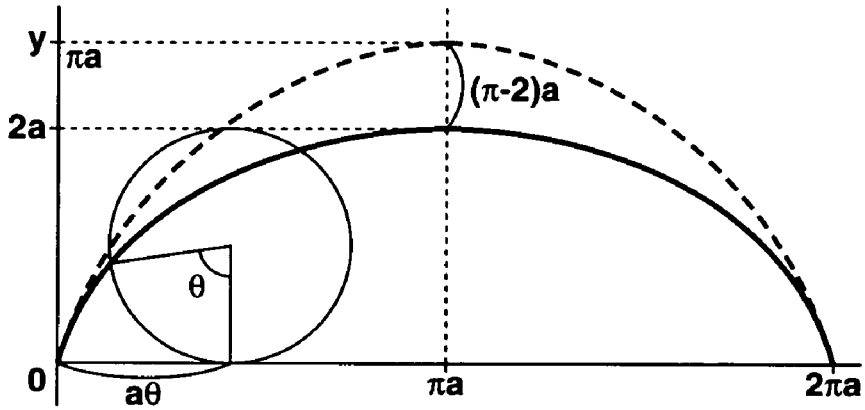
FIG. 3 are diagrams illustrating cycloid and trochoid curves.
Figure 3B:
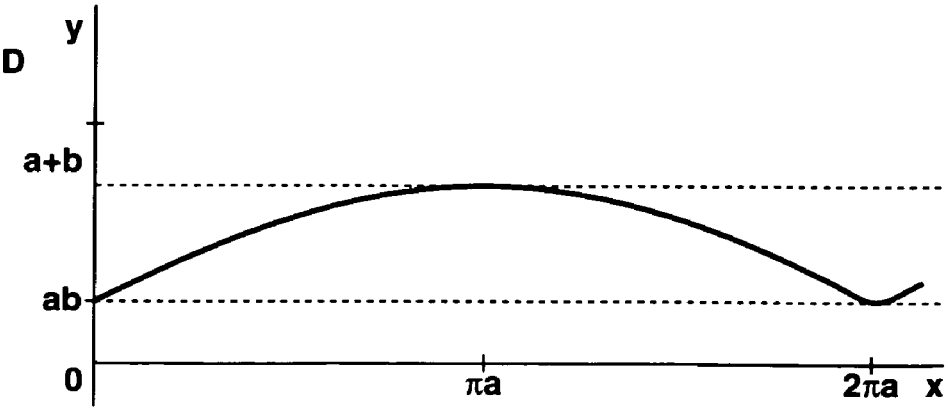

In the practice of the invention, as shown in FIG. 3, the dimple diameter, depth and volume are all determined once the values for the variables a and/or b in the cycloid and/or trochoid curve have been set. In particular, because some 300 to 600 dimples of one or more type are arranged on the surface of the golf ball cover, there are limitations on the degree to which the respective dimple diameters can be suitably changed at will. Hence, if a fixed relationship exists between the respective dimple diameters and the depth and volume of those dimples, arrangement of the dimples can be rapidly carried out.

In particular, when a dimple cross-sectional shape composed of a cycloid curve is used, as shown in FIG. 3, the variable a by itself defines the shape of the dimple, automatically determining its diameter, depth and volume. This makes it possible to speed up design that involves arranging the dimples on the surface of the ball.

The cross-sectional shape of a dimple in the invention refers to the contour of the dimple recess from one edge of the dimple through the deepest portion (base) of the dimple to the other edge. Within the range of 0 to $2\pi a$ shown in FIG. 3, all or part of the curve (locus) in FIG. 3 may be used as the dimple cross-sectional shape.

The cycloid curve, as shown in FIG. 3(A), is a very smooth curve compared with the circular arc curve (dashed line). That is, if a cycloid curve is used as the dimple cross-sectional shape and 2a on the y-axis in FIG. 3 represents the depth of the dimple, a circular arc curve with a diameter of $2\pi a$ would have a depth $\pi a$ which is larger than 2a and would thus be steeper by the amount $(\pi-2)a$. As a result, when a golf ball on which numerous dimples are formed is removed from the mold, the numerous dimple-forming projections on the inside wall of the mold cavity will have a greater tendency to catch, which may worsen the manufacturability of the golf ball and compromise the quality of the dimples.

The total number of dimples formed on the surface of the ball is preferably at least 250, and more preferably at least 300. Although not subject to any particular upper limit, the total number of dimples on the ball is preferably not more than 1,000, and more preferably not more than 700.

The proportion of dimples having a cross-sectional shape that is a cycloid curve or a trochoid curve accounts for preferably not more than 80%, and most preferably not more than 70%, of the total number of dimples.

The dimples used in the invention may be dimples which, as seen in a top plan view, are either circular dimples or non-circular dimples having elliptical shapes or any of various polygonal shapes, or may be a combination thereof. It is especially preferable for circular dimples to account for at least 90% of the total number of dimples, and for non-circular dimples to account for at most 10% of the total number of dimples. As used herein, "circular" and "non-circular" refer to the shape of the dimple as it appears on a flat plane when the ball is viewed from directly above; that is, the contour shape of the dimple edge.

The same applies to the shape as seen in a top plan view—whether circular or non-circular—of the dimples endowed with a cross-sectional shape that is a cycloid curve or a trochoid curve.

The individual dimples have diameters of preferably at least 2.0 mm, and more preferably at least 2.5 mm, but preferably not more than 6.0 mm, and more preferably not more than 5.0 mm.

The individual dimples have depths of preferably at least 0.05 mm, and more preferably at least 0.08 mm, but preferably not more than 0.5 mm, and more preferably not more than 0.4 mm.

In the practice of the invention, the number of dimple types is not limited to one, and may be two or more, and more preferably three or more, but generally is not more than 15, and preferably not more than 11. "Dimple types" refers herein to dimples of differing diameter and/or depth. To illustrate, when three kinds of dimples with a large, medium or small diameter all have the same depth, the dimples are considered to be of three different types.

Preferred examples of the pattern in which the dimples are arranged over the spherical surface of the ball include spherical icosahedral, spherical dodecahedral and spherical octahedral patterns. Examples of the units that may be used in such spherical polyhedral arrangements include unit polygons such as unit triangles and unit pentagons. That is, the dimples may be arranged according to a repeating pattern of such unit polygons on the above-described spherical polyhedron. Moreover, it is possible to vary the diameters of all the dimples by a small amount each.

Viewing the arrangement of dimples two-dimensionally, the sum of the dimple surface areas as a ratio SR with respect to the total surface area of the golf ball, i.e., the planar surface area of each dimple circumscribed by the edge of the dimple, summed for all the dimples on the ball, as a ratio SR with respect to the surface area of the ball were it to have no dimples thereon, is preferably 70 to 89%.

Viewing the arrangement of dimples three-dimensionally, the volume of each dimple below a flat plane circumscribed by the edge of the dimple, summed for all the dimples on the ball, as a ratio VR with respect to the ball volume were it to have no dimples thereon, may be set to at least 0.6%, and preferably at least 0.7%.

The dimples in this case have a depth of generally at least 0.05 mm, and preferably at least 0.08 mm, but generally not more than 0.5 mm, and preferably not more than 0.4 mm. The upper limit in the ratio VR is generally set to 1.7% or less, preferably 1.65% or less, and more preferably 1.6% or less. By setting the dimple spatial occupancy within the above range, the ball when hit with a distance club such as a driver can be prevented from arcing too high or from failing to climb sufficiently and dropping.

Because the dimples on the surface of the golf ball are formed on the outermost layer of the ball, when the cover that will serve as the outermost layer is injection molded, it is desirable to impress the numerous dimple shapes onto the surface at the same time that the cover is injection molded. To fabricate a mold (a two-part type mold) for this purpose, a technique may be employed in which, when dimples having the desired cross-sectional shape are to be formed on the surface of the ball, 3D CAD/CAM is used to directly cut an entire surface shape identical to the intended surface shape of the ball three-dimensionally into a master mold from which the golf ball mold is subsequently made by pattern reversal, or to directly cut three-dimensionally the inside walls of the cavity for the golf ball mold.

The surface of the ball may be administered any of various coatings in the same manner as in the prior art, such as a white enamel coating, an epoxy coating or a clear coating. In doing so, it is desirable for the coating to be carried out uniformly so as not to adversely affect the cross-sectional shape of the dimples.

Figure 4:
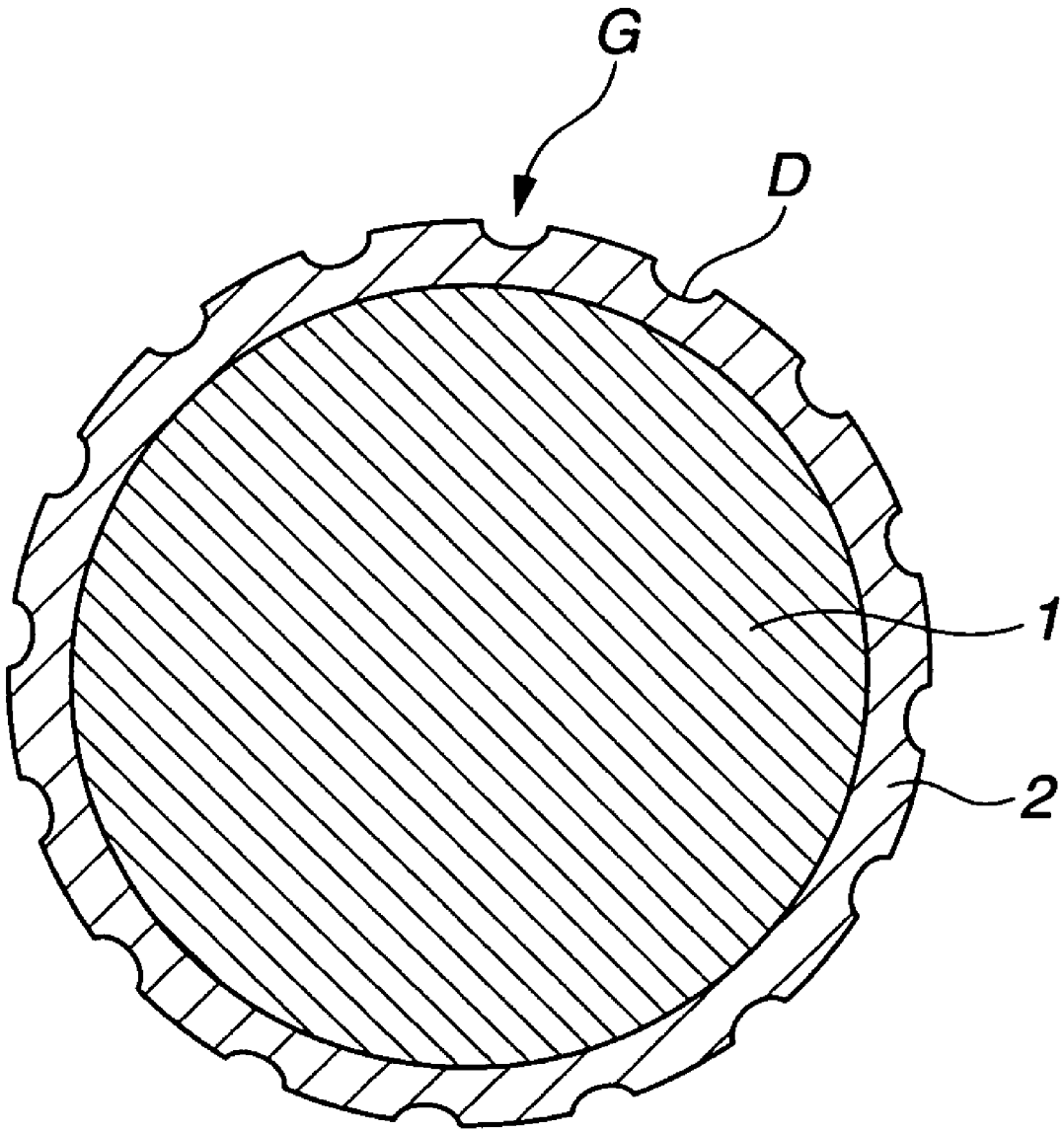
FIG. 4 is a cross-sectional view of a golf ball showing the layer construction at the interior of the ball.

The inventive golf ball is not subject to any particular limitation with regard to ball construction, and may be a solid golf ball such as a one-piece golf ball, a two-piece golf ball or a multi-piece golf ball of three or more layers, or may be a thread-wound golf ball. That is, the invention is applicable to all types of golf balls. In particular, it is desirable for the ball to have, as shown in FIG. 4, a resilient solid core and a cover, although preferred use may be made of a multi-layer construction additionally having one or more intermediate layer disposed between the resilient solid core and the cover. In FIG. 4, the symbol 1 represents the resilient core, and the symbol 2 represents the cover.

The resilient core 1 is typically made of any of various synthetic rubbers, but is in particular preferably composed primarily of a polybutadiene rubber. The solid core has a hardness, expressed as the compressive deflection when subjected to loading from an initial load of 98 N (10 kgf) to a final load of 1,274 N (130 kgf), which, while not subject to any particular limitation, is typically at least 2.0 mm, and preferably at least 2.5 mm, but typically not more than 4.5 mm, and preferably not more than 4.0 mm.

The material making up the cover 2 may be suitably selected from among known thermoplastic resins and thermoset resins, such as ionomer resins, urethane resins, polyolefin elastomers, polyester elastomers and polyamide elastomers.

The cover has a Shore D hardness which, while not subject to any particular limitation, for reasons having to do with the spin rate and rebound of the ball, is generally at least 45, preferably at least 50, and more preferably at least 60, but generally not more than 75, and preferably not more than 68.

The cover has a thickness which, while not subject to any particular limitation, may be set in a range of preferably 0.5 to 2.5 mm, and more preferably 1.0 to 1.5 mm.

Ball specifications such as the ball weight and diameter may be suitably set in accordance with the Rules of Golf.

As described above, the golf ball of the invention, by optimizing the cross-sectional shape of the dimples, enables efficient quantification of the dimple sizes and volumes, thus enhancing dimple quality and stability. As a result, the aerodynamic performance of the ball attributable to the dimple effect can be further improved, making it possible to increase the distance traveled by the ball.

EXAMPLES

Examples of the invention and Comparative Examples are given below by way of limitation, and not by way of limitation.

Example 1, Comparative Examples 1 and 2

The golf balls in the example of the invention and the comparative examples are two-piece solid balls G having an internal construction composed of, as shown in FIG. 4, a core 1 and a cover 2 on which numerous dimples D have been formed. The balls are described in greater detail below.

Core

The following materials were used: 100 parts by weight of polybutadiene (product name, BR01; produced by JSR Corporation), 25 parts by weight of zinc acrylate, 0.8 part by weight of dicumyl peroxide (product name, Percumyl D; produced by NOF Corporation), 0.8 part by weight of 1,1-bis (t-butylperoxy)-3,3,5-trimethylcyclohexane (product name, Perhexa 3M-40; produced by NOF Corporation), 0.2 part by weight of antioxidant (product name, Nocrac NS-6; produced by Ouchi Shinko Chemical Industry Co., Ltd.), 25 parts by weight of zinc oxide, 0.5 part by weight of the zinc salt of pentachlorothiophenol, and 5 parts by weight of zinc stearate. In each example, the core material composed of these ingredients was vulcanized in a core mold at a temperature of 160° C. for a period of 20 minutes, thereby forming a solid core. The core hardness, measured as the compressive deflection on loading from an initial load of 10 kgf to a final load of 130 kgf (hardness on loading from 10 kgf to 130 kgf), was 3.5 mm.

Cover

Next, the solid core was set in a mold, and the cover was injection molded within the mold. The cover material was a mixture composed of 50 parts by weight of an ionomer resin having the trade name Himilan 1605 (DuPont-Mitsui Polychemicals Co., Ltd.) and 50 parts by weight of an ionomer resin having the trade name Himilan 1706 (DuPont-Mitsui Polychemicals). The cover had a Shore D hardness of 63.

Ball Tests

The resulting golf balls were measured for distance. In the tests, a driver (W#1) was mounted on a swing machine and adjustments were made so that the initial velocity at the moment of impact with the ball was 45 m/s and the launch angle was 10°. The measured results are given in Table 1.

TABLE 1

Figure 1A:
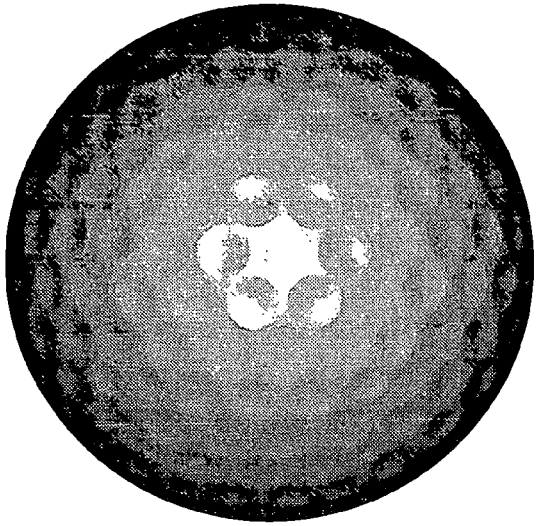
FIG. 1(A) is a photograph of a golf ball according to an example of the invention.
Figure 1B:
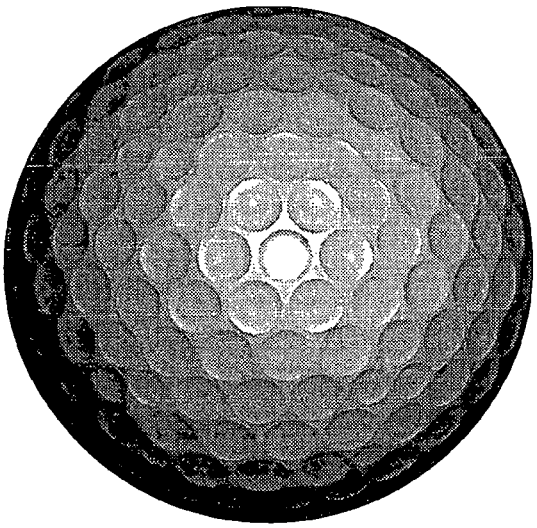
FIGS. 1(B) and (C) are photographs of prior-art golf balls.
Figure 1C:
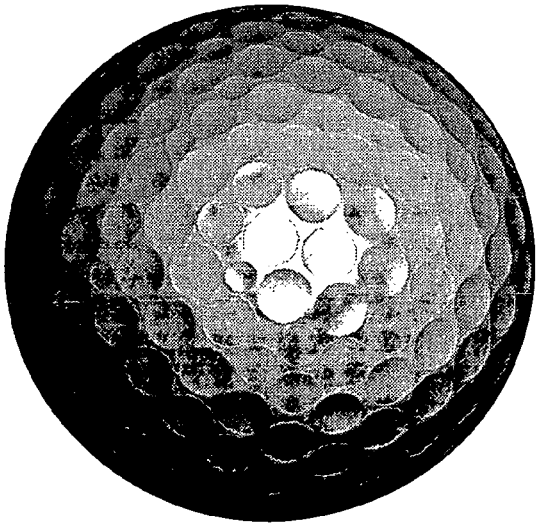

| | | Example 1 | Comparative Example 1 | Comparative Example 2 |
|---|---|---|---|---|
| Dimple photograph | | FIG. 1(A) | FIG. 1(B) | FIG. 1(C) |
| Cross-sectional dimple shape | | cycloid | double | circular arc (ordinary) |
| Number of dimples | | 306 | 306 | 306 |
| Dimple surface coverage SR (%) [1] | | 80% | 80% | 78% |
| Dimple spatial occupancy VR (%) [2] | | 1.32 | 1.4 | 1.31 |
| Test results | Carry (m) | 220.7 | 220.5 | 219.1 |
| | Total distance (m) | 232.3 | 230.4 | 228.9 |

[1] Dimple Surface Coverage SR (%): The dimple surface coverage SR is the sum of the individual dimple surface areas, each defined by the border of the flat plane circumscribed by the edge of the dimple, expressed as a percentage of the spherical surface area of the ball were the ball to have no dimples thereon.

[2] Dimple Spatial Occupancy VR (%): The dimple spatial occupancy VR is the sum of the spatial volumes of the individual dimples, each enclosed by the outermost peripheral surface of the ball and the inside wall of the dimple, divided by the volume of the sphere enclosed by the outermost peripheral surface, and multiplied by 100.

The invention claimed is:

1. A golf ball comprising numerous dimples on a surface thereof, wherein at least one dimple cross-sectional shape obtained by transecting the ball from an outer surface to a center of the ball is a cycloid curve or a trochoid curve.

2. The golf ball of claim 1, wherein the dimples formed on the surface of the ball are of at least three types of differing diameter and/or depth.

3. The golf ball of claim 1, wherein the dimples for which said cross-sectional shape is a cycloid curve or a trochoid curve account for at most 80% of the total number of dimples.

4. The golf ball of claim 1, wherein a total number of dimples ranges from 250 dimples to 700 dimples.

5. The golf ball of claim 1, wherein dimple diameters of the numerous dimples ranges from 2.0 mm to 6.0 mm.

6. The golf ball of claim 1, wherein a two dimensional surface area of dimples on the surface of the golf ball as measured by a planar surface of each dimple circumscribed by an edge of each dimple, summed for all the dimples on the surface, ranges from 70 percent to 89 percent of a total outer surface area of the golf ball.

7. The golf ball of claim 1, wherein the dimple depths of the numerous dimples ranges from 0.05 mm to 0.5 mm.

* * * * *